US008981670B2

(12) United States Patent
Yamamoto

(10) Patent No.: US 8,981,670 B2
(45) Date of Patent: Mar. 17, 2015

(54) LUMINAIRE AND LIGHTING CONTROL SYSTEM

(71) Applicant: Toshiba Lighting & Technology Corporation, Tokosuka-shi, Kanagawa-ken (JP)

(72) Inventor: Hisashi Yamamoto, Yokosuka (JP)

(73) Assignee: Toshiba Lighting & Technology Corporation, Yokosuka-shi, Kanagawa-ken (JP)

( * ) Notice: Subject to any disclaimer, the term of this patent is extended or adjusted under 35 U.S.C. 154(b) by 0 days.

(21) Appl. No.: 14/029,919

(22) Filed: Sep. 18, 2013

(65) Prior Publication Data

US 2014/0292224 A1 Oct. 2, 2014

(30) Foreign Application Priority Data

Mar. 27, 2013 (JP) ..... 2013-066686

(51) Int. Cl.
*H05B 37/02* (2006.01)
*H05B 33/08* (2006.01)

(52) U.S. Cl.
CPC ..... *H05B 37/0263* (2013.01); *H05B 33/0845* (2013.01); *H05B 37/0245* (2013.01)
USPC ..... 315/294; 315/312; 315/319

(58) Field of Classification Search
None
See application file for complete search history.

(56) References Cited

U.S. PATENT DOCUMENTS 8,755,913 B2 * 6/2014 McCormack ..... 700/19
2005/0275626 A1 * 12/2005 Mueller et al. ..... 345/156
2014/0167645 A1 * 6/2014 Takahashi et al. ..... 315/297

FOREIGN PATENT DOCUMENTS

JP 2012-009265 A 1/2012

* cited by examiner

*Primary Examiner* — Jany Richardson
(74) *Attorney, Agent, or Firm* — Banner & Witcoff, Ltd.

(57) ABSTRACT

According to one embodiment, a storing section stores a first group address allocated to a luminaire, stores, as a second group address, the first group address allocated to another luminaire, and stores control information corresponding to the second group address. A control section subjects, when the receiving section receives a control signal including the second group address, a light source section to lighting control on the basis of the control information corresponding to the second group address stored in the storing section.

12 Claims, 6 Drawing Sheets

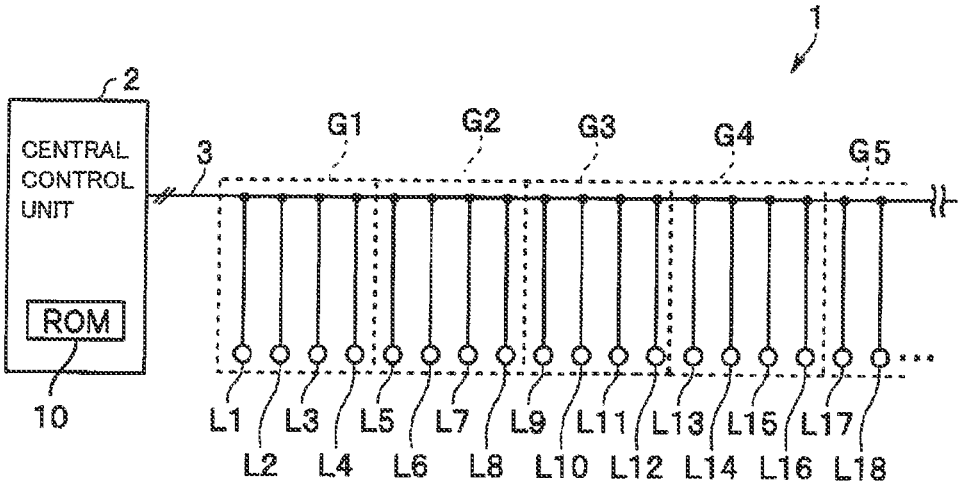
FIG. 1
11
| GROUP | LED DEVICE |
|---|---|
| G1 | L1, L2, L3, L4 |
| G2 | L5, L6, L7, L8 |
| G3 | L9, L10, L11, L12 |
| G4 | L13, L14, L15, L16 |
| ⋮ | ⋮ |
FIG. 2
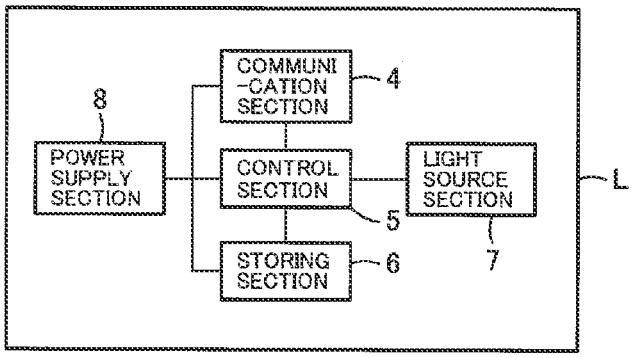
FIG. 3

| | | | | | |
|---|---|---|---|---|---|
| 1 | 1 | 5 | 5 | 9 | 9 |
| 1 | 1 | 5 | 5 | 9 | 9 |
| 2 | 2 | 6 | 6 | 10 | 10 |
| 2 | 2 | 6 | 6 | 10 | 10 |
| 3 | 3 | 7 | 7 | 11 | 11 |
| 3 | 3 | 7 | 7 | 11 | 11 |
| 4 | 4 | 8 | 8 | 12 | 12 |
| 4 | 4 | 8 | 8 | 12 | 12 |

FIG. 4

| | | | | | |
|---|---|---|---|---|---|
| 1 | 1 | 5 | 5 | 9 | 9 |
| 1 | 1 | 5 | 5 | 9 | 9 |
| 2 | 2 | 6 | 6 | 10 | 10 |
| 2 | 2 | 6 | 6 | 10 | 10 |
| 3 | 3 | 7 | 7 | 11 | 11 |
| 3 | 3 | 7 | 7 | 11 | 11 |
| 4 | 4 | 8 | 8 | 12 | 12 |
| 4 | 4 | 8 | 8 | 12 | 12 |

FIG. 5

12

| | | CONTROL INFORMATION | |
|---|---|---|---|
| | | DIMMING DEGREE | RATIO |
| OWN ID | ID6-4 | | |
| OWN GROUP | G6 | 70% | 1 |
| PERIPHERAL GROUPS | G7 | 30% | 0.5 |
| | G10 | 30% | 0.5 |
| | G11 | 30% | 0.5 |

FIG. 6

LUMINAIRE AND LIGHTING CONTROL SYSTEM

INCORPORATION BY REFERENCE

The present invention claims priority under 35 U.S.C. §119 to Japanese Patent Application No. 2013-066686 filed on Mar. 27, 2013. The content of the application is incorporated herein by reference in their entirety.

FIELD

Embodiments described herein generally relate to a luminaire and a lighting control system.

BACKGROUND

Hitherto, for example, in office buildings, various facilities, and the like, a lighting control system that remotely controls lighting loads such as a luminaire arranged in each of lighting areas such as floors and areas has been adopted.

In the lighting control system, a plurality of lighting devices is communicably connected to a central control unit, which is a lighting control apparatus, via transmission lines. The respective lighting devices are controlled by signals transmitted from the central control unit. Since the central control unit and the plurality of lighting devices communicate via the transmission lines, the central control unit can comprehensively manage the lighting devices.

In the lighting system in the past, a plurality of lighting loads can be collectively controlled as groups. However, for example, when the groups are discretely lit, a user present at an end of the groups tends to feel the lighting dark. If all the groups around the user are lit, unnecessary lighting loads are also lit.

BRIEF DESCRIPTION OF THE DRAWINGS

FIG. 1 is a configuration diagram showing the overall configuration of a lighting control system according to an embodiment;

FIG. 2 is an explanatory diagram for explaining an example of an allocation information table stored in a ROM of the lighting control system;

FIG. 3 is a block diagram showing the configuration of a luminaire;

FIG. 4 is a plan view schematically showing an example of a layout of a plurality of LED devices disposed on a ceiling surface;

FIG. 5 is a plan view schematically showing another example of the layout of the plurality of LED devices disposed on the ceiling surface;

FIG. 6 is an explanatory diagram for explaining an example of a setting information table;

DETAILED DESCRIPTION

Figure 7:
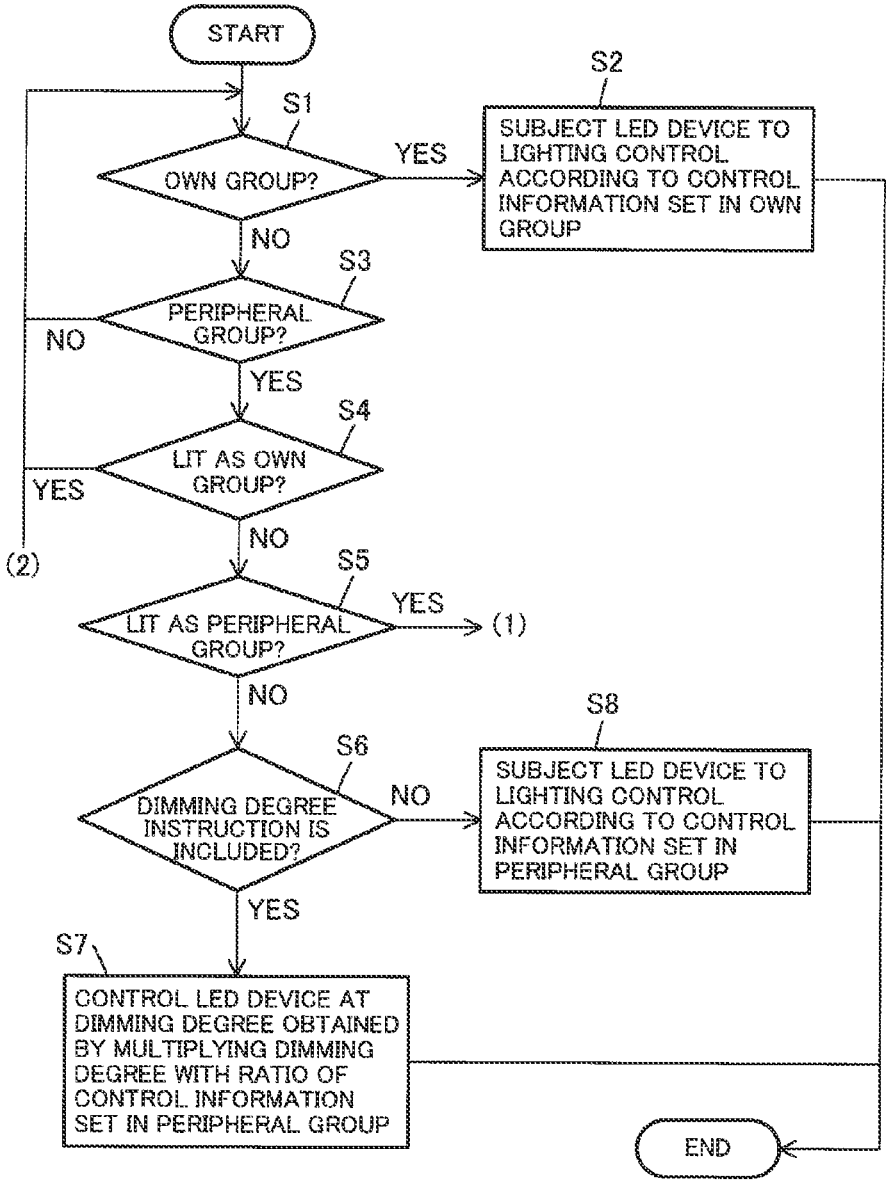
FIG. 7 is a flowchart for explaining an example of lighting control in a control section of the luminaire.

In general, according to an embodiment, a luminaire includes a light source section, a storing section, a receiving section, and a control section. The storing section stores a first group address allocated to the luminaire, stores the first group address allocated to another luminaire as a second group address, and stores control information corresponding to the second group address. The receiving section receives a control signal. The control section subjects, when the receiving section receives a control signal including the second group address, the light source section to lighting control on the basis of the control information corresponding to the second group address stored in the storing section.

It is possible to realize the lighting control system that can subject color temperatures of LED devices allocated to a plurality of groups to lighting control without causing a sense of discomfort.

An embodiment is explained below with reference to FIGS. 1 to 8.

FIG. 1 is a configuration diagram showing the overall configuration of a lighting control system 1.

The lighting control system 1 shown in FIG. 1 includes a central control unit 2 configured to remotely control luminaire set in each of lighting areas such as floors and areas of, for example, office buildings and various facilities.

A plurality of LED devices L (LED devices L1 to L18) configuring after-mentioned dimmable luminaire is connected to the central control unit 2 via a transmission line 3.

In the explanation in this embodiment, the dimmable LED device L is used as the luminaire. However, the luminaire may be a luminaire capable of changing a color temperature. Instead of the LED device L, the luminaire may be an OLED device including a light source such as an organic light emitting diode (hereinafter referred to as OLED) capable of changing a color temperature.

The plurality of LED devices L is controlled by the central control unit 2 via the transmission line 3. That is, the central control unit 2 comprehensively controls the system.

The plurality of LED devices L is respectively allocated to predetermined groups. Information concerning the allocation is stored in a ROM 10 of the central control unit 2 as a table.

FIG. 2 is an explanatory diagram for explaining an example of an allocation information table 11 stored in the ROM 10.

As shown in FIG. 2, the LED devices L1 to L4 are allocated to a group G1, the LED devices L5 to L8 are allocated to a group G2, the LED devices L9 to L12 are allocated to the group G3, and the LED devices L13 to L16 are allocated to a group G4. Similarly, four LED devices L are set as one group for a group G5 and subsequent groups. However, the groups are not shown in the figure.

The number of LED devices L allocated to the respective groups is not limited to four. Other numbers of LED devices L may be allocated. Different numbers of LED devices L may be allocated to the groups.

FIG. 3 is a block diagram showing the configuration of the LED device L. The LED device L includes a communication section 4 functioning as a receiving section for communicating with the central control unit 2 via the transmission line 3, a control section 5, a storing section 6, a light source section 7, and a power supply section 8. The control section 5 subjects the light source section 7 to dimming or lighting and extinguishing control. The control section 5 can store control information transmitted via the transmission line 3 and control state of the control section 5 in the storing section 6 and read out information from the storing section 6. The light source section 7 is, for example, an LED. The light source section 7 can irradiate a lighting area.

FIG. 4 is a plan view schematically showing an example of a layout of the plurality of LED devices L set on the ceiling. One square indicates one LED device L. Numbers 1 to 12 described in squares indicate group addresses allocated to the LED devices L.

That is, in FIG. 4, forty-eight LED devices L in total are classified into twelve groups G1 to G12 with four LED devices L1 set as one group.

In this embodiment, when one group G is subjected to lighting control, the LED devices L included in the same group G are controlled the same. The LED devices L surrounding the controlled group G are also subjected to the lighting control.

That is, although the one group G itself is configured by the four LED devices L, four or more LED devices L are actually controlled.

For example, in FIG. 4, the group G6 subjected to the lighting control is indicated by half-tone dot meshing. The LED devices L lit around the group G6 are indicated by hatching. In this way, when the group G6 is subjected to the lighting control, only the LED devices L adjacent to the group G6 among the eight groups G1, G2, G3, G5, G7, G9, G10, and G11 adjacent to the group G6 are subjected to the lighting control.

The LED devices L subjected to the lighting control around the group G6 are preferably subjected to the lighting control at illuminance lower than the illuminance of the LED devices L of the group G6. Consequently, when a desired group G is subjected to the lighting control, feeling of brightness of a user staying in an illumination region illuminated by the LED devices L of the group G is improved and feeling of isolation of the user is reduced. The feeling of brightness indicates a degree that the user recognizes that a space is bright. The feeling of brightness can be quantitatively measured from a subjective evaluation or illuminance by indirect light entering the eyes.

FIG. 6 is a diagram for explaining an example of the setting information table 12 stored in the storing section 6 of the LED device L. One of the LED devices L adjacent to the groups G7, G10, and G11 among the LED devices L set as the group G6 in FIG. 4 is explained. As shown in FIG. 6, in the setting information table 12, an own ID serving as an ID set for the LED device L itself, an own group serving as a first group address allocated to the LED device L, and peripheral groups serving as second group addresses are set. In this embodiment, maximum eight groups can be set as the peripheral groups. However, more than eight groups may be set. In explanation, three groups G7, G10, and G11 are set as the peripheral groups. In the own group and the peripheral groups, a dimming degree and a ratio are set as control information. For the other LED devices L, own groups and peripheral groups are respectively set. For example, for ten LED devices L indicated by hatching in FIG. 5, the group G6 is set as the peripheral group.

First, in an initial state, only own IDs of the LED devices L are stored in the storing sections 6.

Subsequently, when the setting information table 12 is transmitted from the central control unit 2 to the own IDs, the respective LED devices L store the setting information table 12 including the own IDs in the storing sections 6. Since adjacent groups of the respective LED devices L are different, the central control unit 2 needs to transmit the setting information table 12 equivalent to the number of the LED devices L. All the LED devices L may have the same dimming degree and the same ratio as control information for the peripheral groups or each of the LED devices L may have a different kind of control information.

Further, operation programs of the setting information table 12 are transmitted from the central control unit 2 and stored in the respective LED devices L. The operation programs may be transmitted all together or may be individually transmitted. When the operation programs are individually transmitted, the operation programs are transmitted from the central control unit 2 together with the setting information table 12 and stored in the storing sections 6 of the LED devices L.

When, for example, a control signal including the group G6 is transmitted from the central control unit 2, the LED device L allocated with the group G6 as the own group is lit, for example, at a preset dimming degree of 70% on the basis of the setting information table 12.

Further, for the ten LED devices L disposed around the group G6 and indicated by hatching, the group G6 is set as the peripheral group. When the LED devices L indicated by hatching receive the control signal including the group G6, the LED devices L read out dimming degrees from control information corresponding to the group G6 of the peripheral group and subject the light source sections 7 to lighting control. For example, when it is assumed that a dimming degree of 30% is set for the peripheral group of the LED devices L indicated by hatching as in the setting information table 12, the LED devices L indicated by hatching are also lit at the dimming degree of 30%. When a control signal for lighting the group G6 at a dimming degree of 80% is transmitted from the central control unit 2, the LED device L for which the group G6 is set as the own group selects a ratio 1 from the setting information table 12 and is lit at the dimming degree of 80%. On the other hand, the LED device L for which the group G6 is set as the peripheral address is controlled at a value obtained by multiplying the dimming degree 80% with a ratio stored as control information. For example, if it is assumed that a ratio 0.5 is set to correspond to the group G6 set as the peripheral group, the LED device L is lit at a dimming degree of 40%.

FIG. 5 shows a state in which the group G11 is further subjected to the lighting control in the lighting state shown in FIG. 4. In the figure, the LED devices L adjacent to the group G11 among the groups G7, G8, G10, and G12 and indicated by hatching are further lit as the peripheral groups. Both of the LED device L arranged at the lower right in the group G6 and the LED device L arranged at the upper left in the group G11 are lit as the own groups and lit as the peripheral groups as well. In such a case, the control sections 5 of the LED devices L perform the lighting control while prioritizing the control information of the own groups. When the control information of the own groups is extinction, the control sections 5 prioritize lighting of the peripheral groups.

For the LED device L arranged at the upper right in the group G7 and the LED device L arranged at the lower left in the G10, the groups G6 and G11 are set as the peripheral groups. In such a case, when different dimming degrees and different ratios are set for the groups G6 and G11 as the control information of the peripheral groups, the control sections 5 perform the lighting control while prioritizing the control information with a large dimming degree, i.e., a large output.

In this way, in this embodiment, it is possible to realize, while realizing energy saving, an illumination environment in which feeling of brightness is improved and feeling of isolation is suppressed. Further, it is possible to perform complicated gradation control simply by transmitting a control signal including group addresses to be controlled from the central control unit 2. That is, after the setting information table 12 is set for all the LED devices L once, the central control unit 2 only has to perform control for the groups set in the ROM 10 of the central control unit 2. Therefore, compared with control performed by transmitting all kinds of control information from the central control unit 2, a communication network is not complicated and setting work in the central control unit 2 and control content can be simplified. In particular, when the central control unit 2 controls a plurality of groups, in performing priority control among the peripheral groups of the groups, the central control unit 2 does not need to perform the control after grasping states of the LED devices L.

Figure 8:
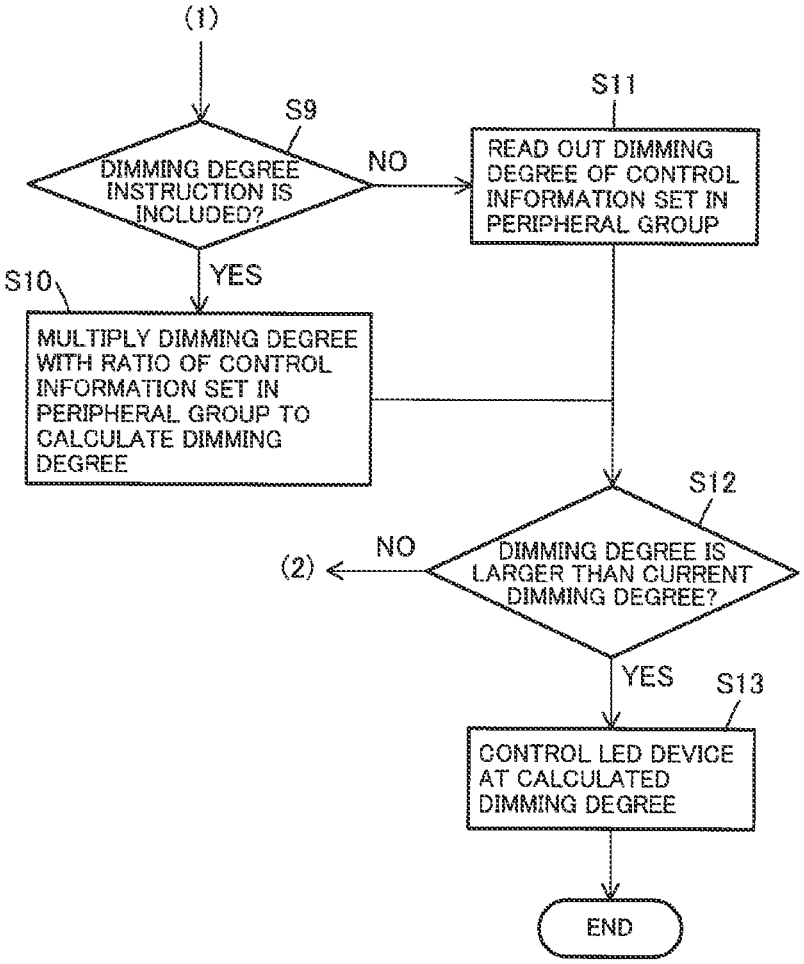
FIG. 8 is a flowchart for explaining the example of the lighting control in the control section of the luminaire.

Action of the luminaire according to this embodiment is explained with reference to FIGS. 7 and 8. FIGS. 7 and 8 are flowcharts for explaining an example of the lighting control in the control section 5 of the LED device L.

The control section 5 of the LED device L reads out a computer program for executing processing from the storing section 6 and executes the computer program. The computer program is, for example a computer program executed when a control signal is received from the central control unit 2.

When the control section 5 receives a control signal, in processing in Step S1, the control section 5 determines whether a group address of the LED device L is included in the control signal. When the group address of the LED device L is included in the control signal, the control section 5 shifts to processing in Step S2.

In processing in Step S2, the control section 5 subjects the LED device L to the lighting control according to control information included in the control signal or control information stored in the storing section 6, i.e., control information corresponding to the own group and ends the flow.

When determining in the processing in Step S1 that the group address of the LED device L is not included in the control signal, the control section 5 shifts to processing in Step S3. In the processing in Step S3, the control section 5 determines whether a peripheral group is included in the control signal. When a peripheral group is not included in the control signal, the control section 5 returns to Step S1. When determining that a peripheral group is included in the control signal, the control section 5 shifts to processing in Step S4.

In the processing in Step S4, the control section 5 determines whether the LED device L is subjected to the lighting control as the own group. When the LED device L is subjected to the lighting control as the own group, the control section 5 returns to Step S1. When the LED device L is not subjected to the lighting control as the own group, the control section 5 shifts to processing in Step S5.

In the processing in Step S5, the control section 5 determines whether the LED device L is subjected to the lighting control as the peripheral group. When the LED device L is subjected to the lighting control as the peripheral group, the control section 5 shifts to (1). When the LED device L is not subjected to the lighting control as the peripheral group, the control section 5 shifts to processing in Step S6.

In the processing in Step S6, the control section 5 determines whether an instruction for a dimming degree is included in the control signal. When the instruction of a dimming degree is included in the control signal, the control section 5 shifts to processing in Step S7. In Step S7, the control section 5 reads out a ratio corresponding to a peripheral group address from the control information stored in the storing section 6, multiplies the dimming degree included in the control information with the read-out ratio to calculate a dimming degree as the peripheral group, subjects the LED device L to the lighting control at the calculated dimming degree, and ends the flow.

On the other hand, when determining in the processing in Step S6 that a dimming degree is not included in the control signal, the control section 5 shifts to processing in Step S8, reads out a dimming degree corresponding to the peripheral group address from the control information stored in the storing section 6, subjects the LED device L to the lighting control at the read-out dimming degree, and ends the flow.

A flow performed after the control section shifts to (1) when determining in Step S5 that the LED device L is already lit as the peripheral group is explained with reference to FIG. 8.

The flow is a flow for subjecting, when the LED device L is set as a plurality of peripheral groups and is to be subjected to the lighting control at different dimming degrees, the LED device L to the lighting control while prioritizing a state in which a dimming degree is higher.

In processing in Step S9, the control section 5 determines whether an instruction for a dimming degree is included in the control signal. When the instruction for a dimming degree is included in the control signal, the control section 5 shifts to processing in Step S10. In Step S10, the control section 5 reads out a ratio corresponding to the peripheral group address from the control information stored in the storing section 6, multiplies the dimming degree included in the control information with the read-out ratio to calculate a dimming degree as the peripheral group, and shifts to processing in Step S12.

On the other hand, when it is determined in the processing in Step S9 that a dimming degree is not included in the control signal, the control section 5 shifts to processing in Step S11, reads out a dimming degree corresponding to the peripheral group address from the control information stored in the storing section 6, and shifts to processing in Step S12.

In the processing in Step S12, the control section 5 compares a current dimming degree with the dimming degree calculated or read out in Step S10 or Step S11. When determining that the dimming degree is larger than the current dimming degree, the control section 5 shifts to processing in Step S13 and subjects the LED device L to the lighting control at the dimming degree calculated in Step S12.

On the other hand, when determining in the processing in Step S12 that the dimming degree is smaller than the current dimming degree, the control section 5 shifts to (2) and returns to the processing in Step S1 in FIG. 7.

As explained above, the luminaire (the LED device L) and the lighting control system 1 store the group address of the luminaire and the peripheral group addresses in the luminaire and reflect a control signal transmitted to the other luminaires on the lighting control for the luminaire. Consequently, the luminaire (the LED device L) and the lighting control system 1 can perform fine gradation control. Since the own group and the peripheral groups are set on the luminaire side, it is unnecessary to cause the central control unit 2 to perform complicated setting and control. The transmission line 3 is not congested. That is, the central control unit 2 can realize gradation control simply by subjecting a set group to the lighting control.

The execution order of the acts in the flowcharts in this specification may be changed, a plurality of the acts may be simultaneously executed, or the acts may be executed in different order every time the acts are executed as long as this is not against the characteristics of the acts.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions,

What is claimed is:

1. A luminaire comprising:

a light source section;

a storing section configured to store a first group address allocated to the luminaire, store the first group address allocated to another luminaire as a second group address, and store control information corresponding to the second group address;

a receiving section configured to receive a control signal; and a control section configured to subject, when the receiving section receives a control signal including the second group address, the light source section to lighting control on the basis of the control information corresponding to the second group address stored in the storing section.

2. The luminaire according to claim 1, wherein, when a control signal including the first group address and a control signal including the second group address are received, the control section prioritizes the lighting control according to a control signal including the first group address.

3. The luminaire according to claim 1, wherein the storing section stores a plurality of the second group addresses, and when control signals including different ones of the second group addresses are received, the control section performs the lighting control with a largest output on the basis of the control information corresponding to the second group address.

4. The luminaire according to claim 1, wherein the control section subjects the light source section to the lighting control on the basis of a dimming degree of another unit of the luminaire controlled using the second group address as the first group address.

5. The luminaire according to claim 1, wherein the storing section stores therein an ID allocated to the luminaire and is configured to store the first group address, the second group address, and the control information corresponding to the second group address transmitted to the ID of the luminaire via the receiving section.

6. The luminaire according to claim 1, wherein an output of the lighting control by the control section according to a control signal including the second group address is smaller than an output of the lighting control by the control section according to a control signal including the first group address.

7. A lighting control system comprising:

a luminaire including:

a light source section;

a storing section configured to store a first group address allocated to the luminaire, store, as a second group address, the first group address allocated to another luminaire, and store control information corresponding to the second group address;

a receiving section configured to receive a control signal; and a control section configured to subject, when the receiving section receives a control signal including the second group address, the light source section to lighting control on the basis of the control information corresponding to the second group address stored in the storing section; and a central control unit configured to transmit a control signal including the first group address stored in the luminaire.

8. The system according to claim 7, wherein, when a control signal including the first group address and a control signal including the second group address are received, the control section prioritizes the lighting control according to a control signal including the first group address.

9. The system according to claim 7, wherein the storing section stores a plurality of the second group addresses, and when control signals including different ones of the second group addresses are received, the control section performs the lighting control with a largest output on the basis of the control information corresponding to the second group address.

10. The system according to claim 7, wherein the control section subjects the light source section to the lighting control on the basis of a dimming degree of another unit of the luminaire controlled using the second group address as the first group address.

11. The system according to claim 7, wherein the storing section stores therein an ID allocated to the luminaire and is configured to store the first group address, the second group address, and the control information corresponding to the second group address transmitted to the ID of the luminaire via the receiving section.

12. The system according to claim 7, wherein an output of the lighting control by the control section according to a control signal including the second group address is smaller than an output of the lighting control by the control section according to a control signal including the first group address.

* * * * *